US005735586A

United States Patent [19]

Cheng

[11] Patent Number: 5,735,586

[45] Date of Patent: Apr. 7, 1998

[54] CABINET STRUCTURE THAT IS EXPANDABLE INTO PLATFORM LADDER

[76] Inventor: Nan-Shan Cheng, 7F-2, No. 24-3, Nung-An Street, Taipei, Taiwan

[21] Appl. No.: 832,450

[22] Filed: Apr. 3, 1997

[51] Int. Cl.[6] ..... A47B 83/00

[52] U.S. Cl. ..... 312/235.1; 312/258; 312/237; 182/35

[58] Field of Search ..... 312/235.1, 258, 312/114, 237, 313, 315; 182/35

[56] References Cited

U.S. PATENT DOCUMENTS

| | | | |
|---|---|---|---|
| 1,293,967 | 2/1919 | Stalder | 312/235.1 X |
| 2,495,374 | 1/1950 | Horn | 312/235.1 X |
| 2,628,145 | 2/1953 | Slattery | 312/205 |
| 2,813,769 | 11/1957 | Post | 312/258 |
| 3,030,166 | 4/1962 | Richards et al. | 312/235.1 |
| 3,346,317 | 10/1967 | Peggs | 312/258 |
| 3,897,080 | 7/1975 | Isom | 312/235.1 X |
| 4,429,931 | 2/1984 | Brooks | 312/237 X |
| 5,107,957 | 4/1992 | Bennett | 312/235.1 X |
| 5,358,067 | 10/1994 | Ford et al. | 312/235.1 X |

FOREIGN PATENT DOCUMENTS

| | | | |
|---|---|---|---|
| 3258 | 1/1891 | United Kingdom | 312/237 |
| 694988 | 7/1953 | United Kingdom | 312/235.1 |

*Primary Examiner*—James R. Brittain
*Assistant Examiner*—Hanh V. Tran
*Attorney, Agent, or Firm*—Meltzer, Lippe, Goldstein, Wolf, & Schlissel, P.C.

[57] ABSTRACT

A cabinet structure includes a parallelepiped frame having a top side, a bottom side, a front side, a rear side and two opposite lateral sides. A drawer is provided on the upper portion of the frame, having a front panel comprised of four boards overlapping each other and releasably secured together by means of a bolt. Two L-shaped door panels are respectively hinged to two opposite sides of the frame to openably cover the front side. By opening the two door panels to be opposite to each other and un-folding the boards of the front panel of the drawer to have the boards supported on the L-shaped door panels, a stair-like platform ladder is formed with the top side of the cabinet serving as the platform. A safety rack is provided on the platform and is collapsible into a channel formed inside the cabinet so as to be selectively expanded when the cabinet is converted into the platform ladder. A bench includes a horizontal top plate having a first end movably received within and supported by the cabinet and a second end selectively extendible out of one of the lateral sides of the cabinet and supported by a vertical support plate so that the bench is selectively expanded from the cabinet. A stool is removably stored inside the cabinet and is selectively and removably mounted to the platform to provide an additional step to the ladder.

20 Claims, 16 Drawing Sheets

CABINET STRUCTURE THAT IS EXPANDABLE INTO PLATFORM LADDER

FIELD OF THE INVENTION

The present invention relates generally to a cabinet structure and in particular to a cabinet structure that is expandable into a platform ladder.

BACKGROUND OF THE INVENTION

Cabinets have been commonly used as both household and office furniture to organize articles. Various designs of cabinets have been available in the market. Most of the cabinets that are available in the market have simply the function of storing or organizing articles. Since cabinets are so readily available in both house and office, it is desirable to provide the cabinets with other functions.

On the other hand, ladders are also very common in all kinds of applications for helping people to reach a higher location. Due to the small ground projection area, most of the ladders need another person to hold them in order to prevent the ladders from collapsing or falling down and thus hurting the user of the ladder. Thus a motivation is raised for incorporating the ladder and the cabinet together so as to make use of the larger ground projection area that the cabinet possesses and thus providing a platform ladder which is safer in use.

SUMMARY OF THE INVENTION

The principal object of the present invention is to provide a multi-purpose or multi-function cabinet structure.

It is another object of the present invention to provide a cabinet structure which is expandable into a platform ladder.

It is a further object of the present invention to provide a cabinet structure into which a bench is incorporated in a manner that the bench can be fully stowed inside the cabinet when not in use.

Thus, in accordance with the present invention, there is provided a cabinet structure comprising a parallelepiped frame having a top side, a bottom side, a front side, a rear side and two opposite lateral sides. A drawer is provided on the upper portion of the frame, having a front panel comprised of four boards overlapping each other and releasably secured together by means of a bolt. Two L-shaped door panels are respectively hinged to two opposite sides of the frame to openably cover the front side. By opening the two door panels to be opposite to each other and un-folding the boards of the front panel of the drawer to have the boards supported on the L-shaped door panels, a stair-like platform ladder is formed with the top side of the cabinet serving as the platform. A safety rack is provided on the platform and is collapsible into a channel formed inside the cabinet so as to be selectively expanded when the cabinet is converted into the platform ladder. A bench includes a horizontal top plate having a first end movably received within and supported by the cabinet and a second end selectively extendible out of one of the lateral sides of the cabinet and supported by a vertical support plate So that the bench is selectively expanded from the cabinet. A stool is removably stored inside the cabinet and is selectively and removably mounted to the platform to provide an additional step to the ladder.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
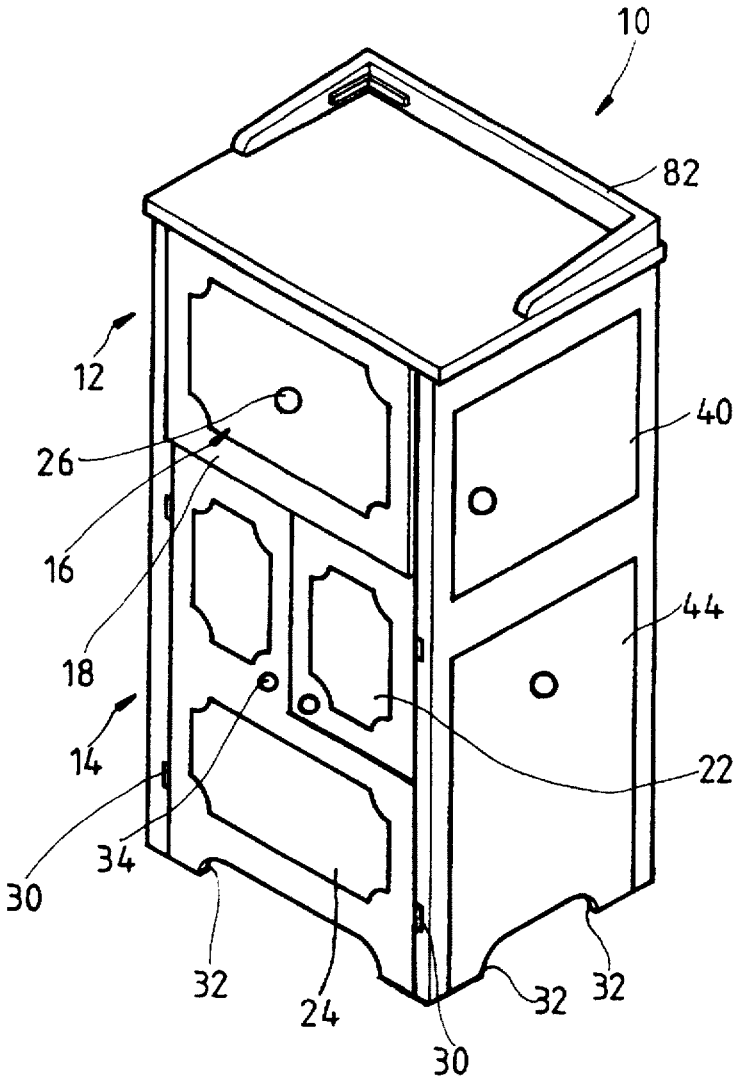
FIG. 1 is a perspective view showing a cabinet constructed in accordance with the present invention.

With reference to the drawings and in particular to FIG. 1, wherein a cabinet constructed in accordance with the present invention, generally designated with reference numeral 10, is shown, the cabinet 10 comprises a parallelepiped frame having a top side, a bottom side, a front side, a rear side and two opposite lateral sides and defining an upper drawer section 12 and a lower bin section 14. The functions of the drawer and the bin are well known and thus no description is needed.

The upper drawer section 12 comprises a drawer 16 movably received within the upper section 12 from the front side of the cabinet 10 with a drawer panel 18 substantially on the front side surface of the cabinet 10. A manual knob 26 is provided on the drawer panel 18.

Figure 4:
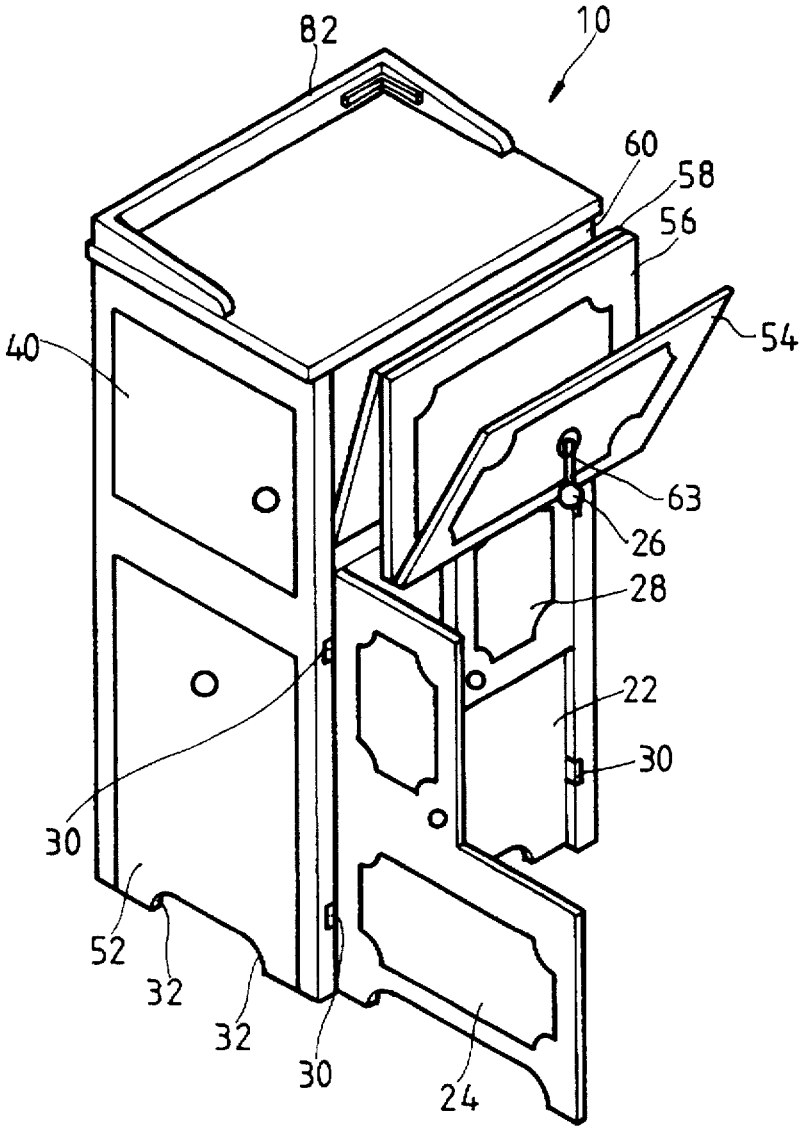
FIG. 4 is a perspective view showing the cabinet of the present invention in an initial condition for being expanded into a ladder.
Figure 5:
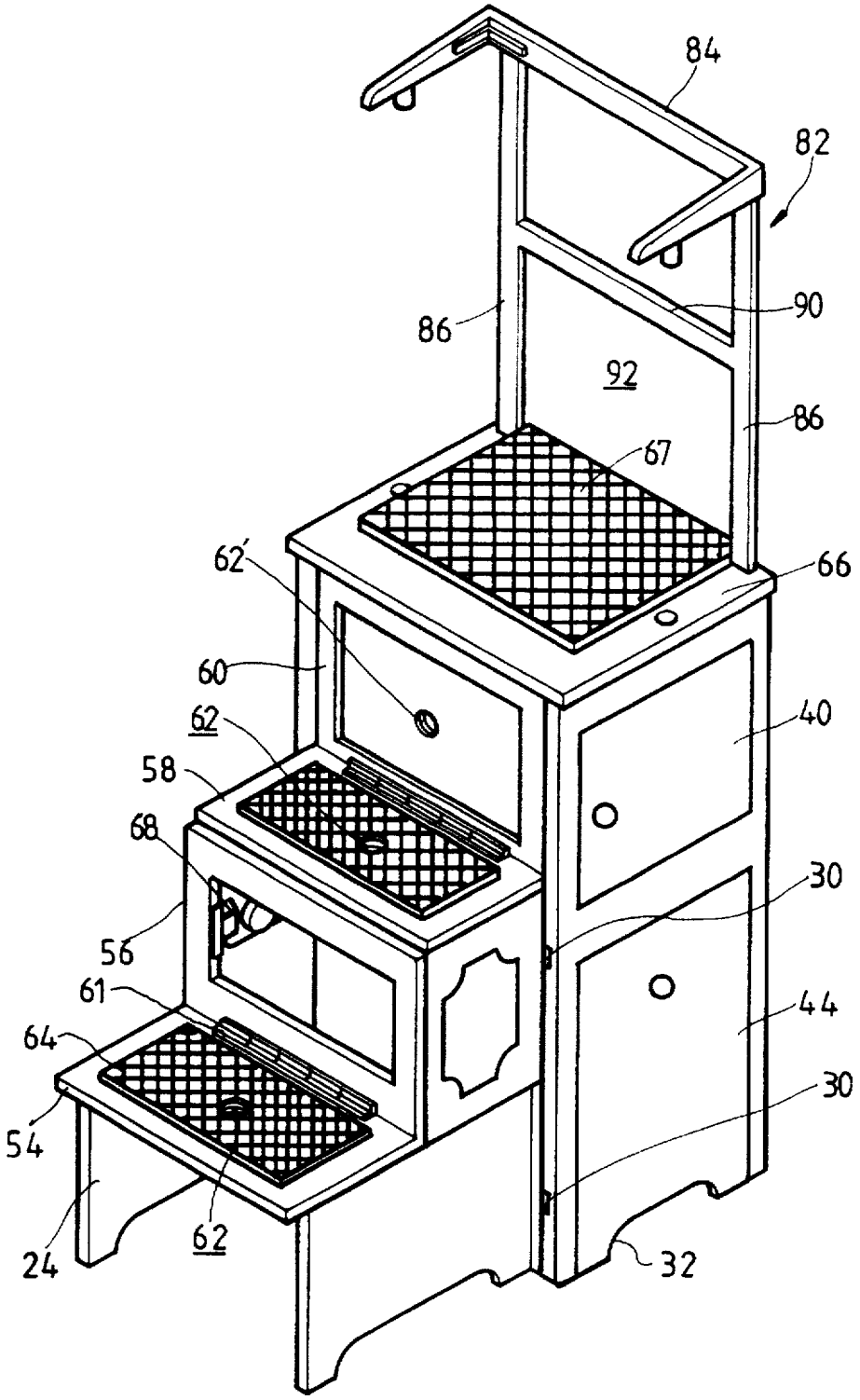
FIG. 5 is a perspective view showing the ladder that is expanded from the cabinet of the present invention.

The bin section 14 comprises two L-shaped door panels 22 and 24, more clearly shown in FIGS. 4 and 5, which are respectively hinged to the parallelepiped frame of the cabinet 10 at 30 to allow the door panels 22 and 24 to be openable frontward as shown in FIG. 4. The two door panels 22 and 24 are arranged to have the lower section of the L partially overlapping each other so that the upper section of the L may fully cover the front side of the cabinet 10. To provide aesthetics, the inner door panel 22 is provided with a rectangular raised portion 28 which is complementary to the L shape of the outer door panel 24 so as to define a substantially flat front surface of the cabinet 10. The two door panels 22 and 24 are so arranged that they are openable to be opposite to and spaced from each other at a distance defined by the width of the cabinet 10, as shown in FIG. 5.

To simplify the discussion, the distance between the two opposite lateral sides of the cabinet 10 is defined as the width of the cabinet 10 herein, that between the top and bottom sides the height of the cabinet 10 and that between the front and rear sides the depth of the cabinet 10. The actual height of the cabinet 10 may be greater than that defined above for legs 32 may be provided under the bottom side of the cabinet 10. Preferably, there are four legs 32 respectively located at four corners of the cabinet 10.

Manual knobs 34 may be provided on both the first and second outer door panels 22 and 24 for opening the door panels 22 and 24.

Figure 6:
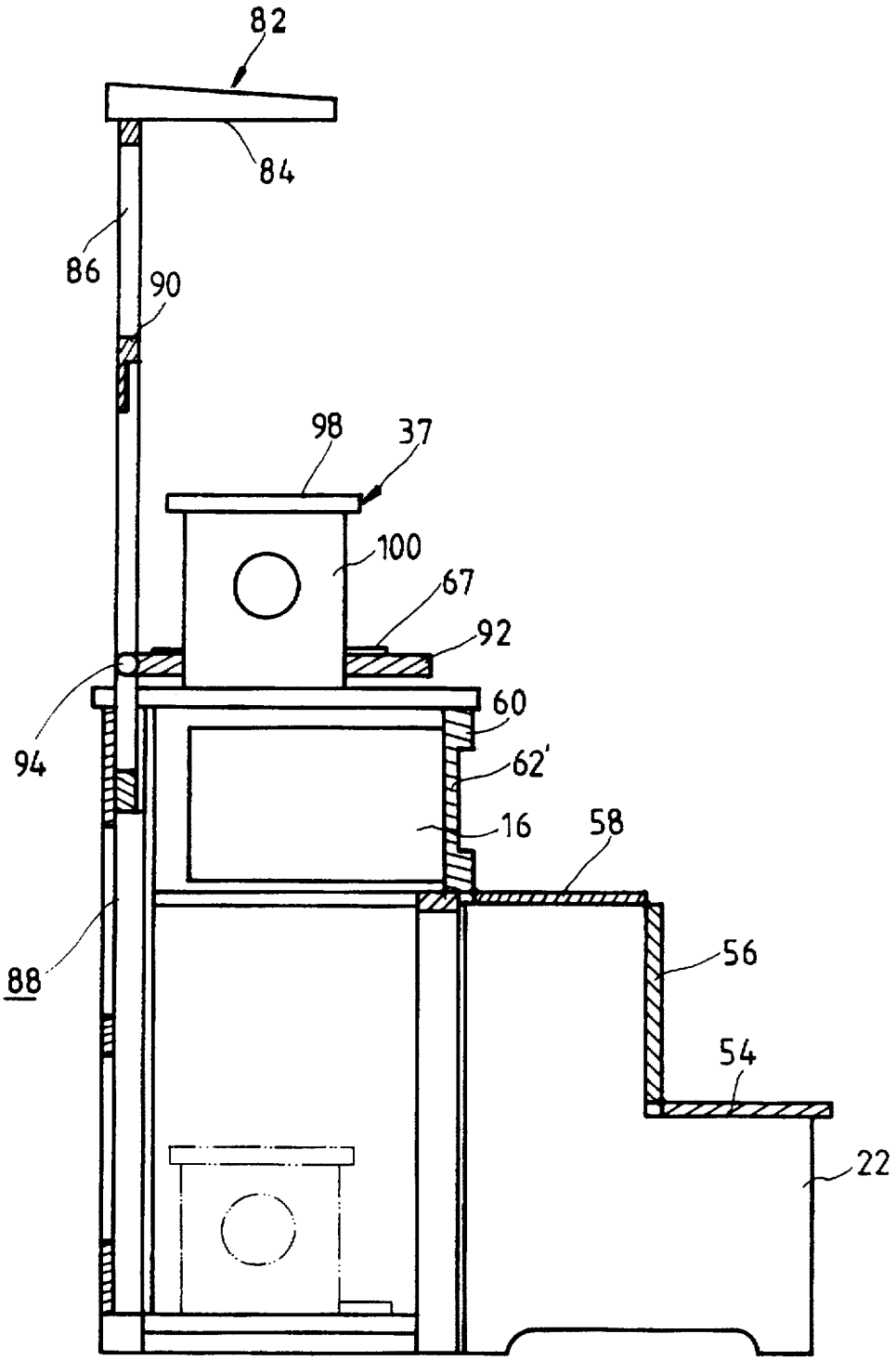
FIG. 6 is a side elevational view showing the ladder with an additional step formed with a removable stool mounted thereon.

Inside the lower bin section 14, an interior space is defined by an inner casing member 35 (see FIG. 2) comprising a horizontal partition wall 35' and two lateral side partition walls 35" with the horizontal partition wall 35' defining a space 36 with the drawer section 12. The interior space of the bin section 14 is accessible by opening the outer door panel 24 and the inner door panel 22. Articles may be stored or stowed in the interior space. In accordance with the present invention, a stool 37 is selectively disposed inside the bin section 14, as shown in FIG. 6. The stool 37 may be retrieved from the bin section 14 for general purpose utilization or may be used in accordance with the present invention which will be further described.

Figure 2:
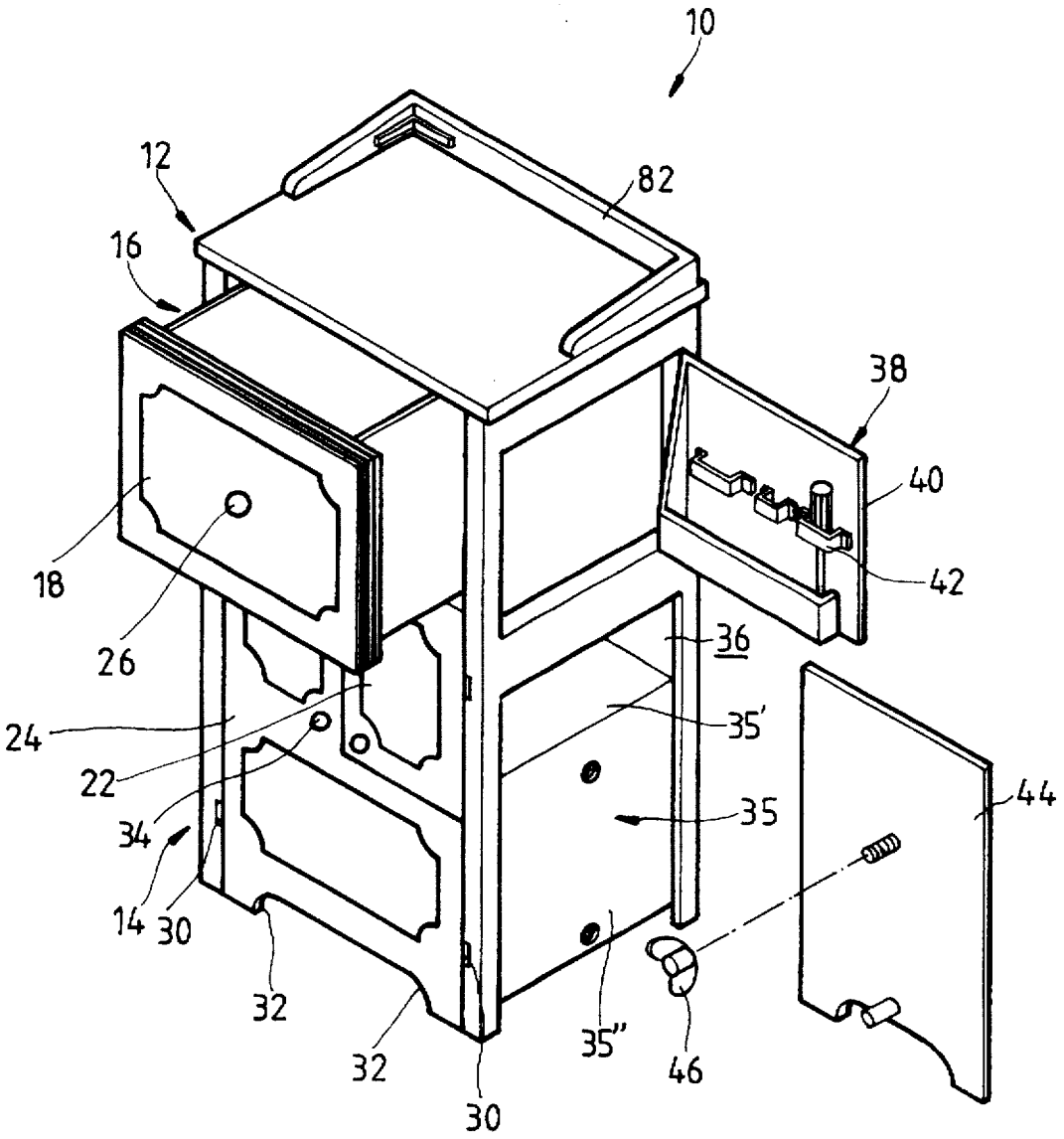
FIG. 2 is a perspective view showing the cabinet of the present invention in an opened condition, wherein a drawer and a hand tool sideboard are opened.

On one or both of the lateral sides of the cabinet 10, a shelf 38 may be provided, more clearly shown in FIG. 2, which comprises a sideboard 40 hinged to the cabinet frame and sized and positioned to correspond to the drawer section 12. Article holder means 42 is fixed inside the sideboard 40 for holding articles thereon. In the embodiment illustrated in FIG. 2, the article holder means 42 comprises a hand tool holder rack on which a number of hand tools may be supported.

The lateral sides of the cabinet 10 corresponding to the bin section 14 are open, as shown in FIG. 2, so as to allow the space 36 defined between the horizontal partition wall 35' of the inner casing member 35 and the drawer section 12 to be accessible. A side panel 44 is removably attached to one of the lateral side partition walls 35" of the inner casing member 35 to cover the opening of one of the lateral sides of the cabinet by means of a bolt and nut pair 46.

A bench 48 comprises a top plate 50 having one end movably received within the space 36 between the horizontal partition wall 35' of the inner casing member 35 and the drawer section 12 and slidably supported on the horizontal partition wall 35' of the inner casing member 35. A leg plate 52 is mounted to an opposite end of the top plate 50 that is selectively extendible out of the cabinet 10 through the other lateral side opening of the cabinet frame that is not covered by the side panel 44 and extending therefrom to the ground so as to support the top plate 50 when the top plate 50 is moved out of the cabinet 10, with the opposite end of the top plate 50 supported by the inner casing member 35 so as define a bench structure.

Figure 3:
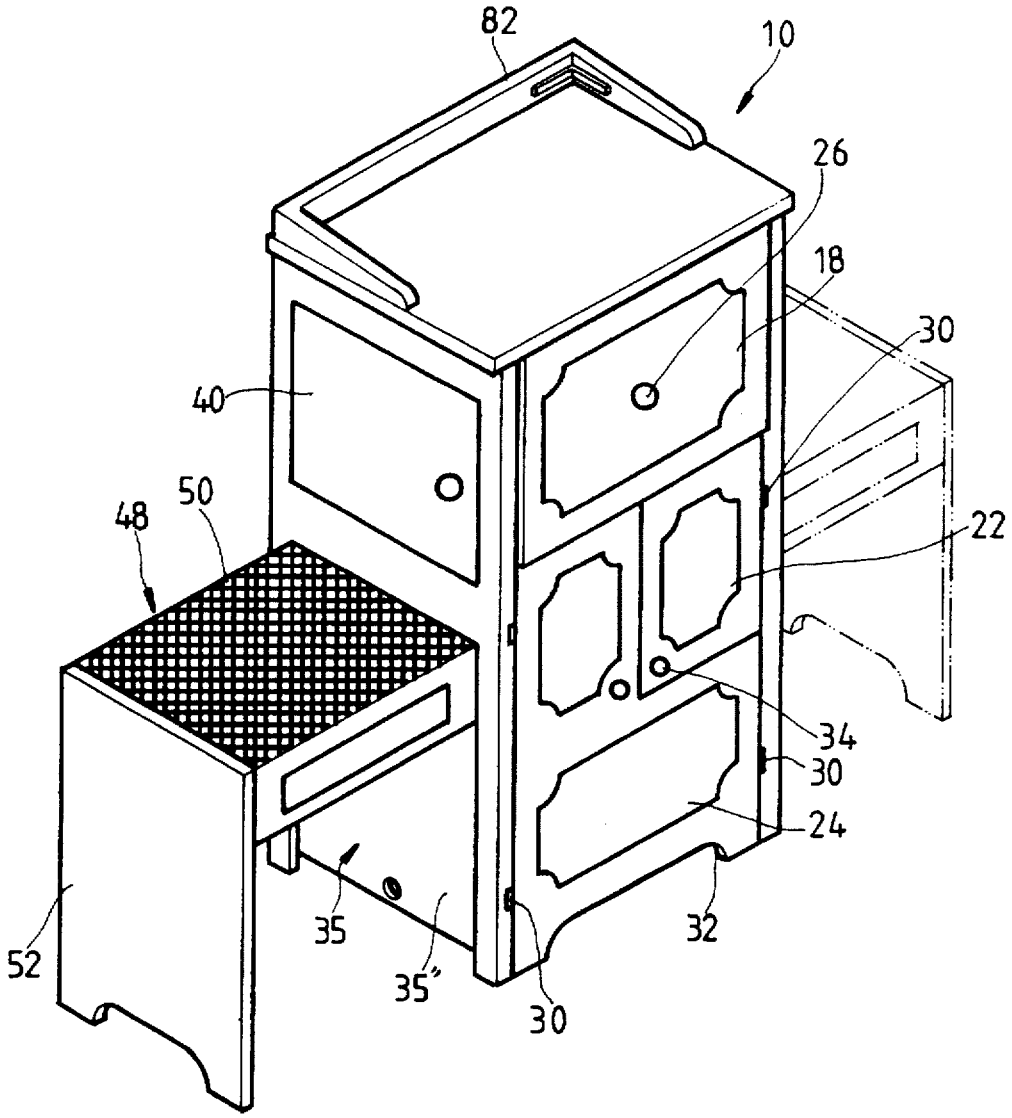
FIG. 3 is a perspective view showing the cabinet of the present invention in another opened condition wherein a bench is expanded.

Preferably, both the two lateral sides of the cabinet 10 are closable by a removably secured side panel 44 so that the bench 48 may be mounted at either one of the lateral sides of the cabinet 10, as shown in FIG. 3. Alternatively, the leg plate 52 may play the role of one of the side panels 44 so that there is only one side panel 44 and the leg plate 52 and the side panel 44 are respectively used to close the lateral side openings of the cabinet frame.

With reference to FIGS. 4 and 5, the front panel 18 of the drawer 16 comprises four boards 54, 56, 58 and 60 of substantially the same size and hinged to each other at 61 so as to be foldable to overlap each other. The boards 54, 56 and 58 are provided with a through hole 62 through which a stem 63 of the manual knob 26 which is threaded extends to engage an inner-threaded hole 62' (best shown in FIG. 8) formed on the fourth board 58 to secure the four board 54, 56, 58 and 60 together in the overlapping condition and serving as the front panel 18 of the drawer 16.

As described above, the L-shaped outer and inner door panels 24 and 22 may be opened to be opposite to and spaced from each other as shown in FIG. 5 so as to define a stair-like configuration that has two steps. The four boards 54, 56, 58 and 60, when expanded, are sized to allow the first and third ones of the boards to be supported on the two steps of the L-shaped panels 22 and 24 so as to define a stair-like structure. The first and third boards 54 and 58 that are supported on the L-shaped panels 22 and 24 serve as the treads of the stair-like structure, while the second and fourth boards 56 and 60 serve as the risers. The riser board 56 may be a hollow rectangular frame as shown in FIGS. 5 and 8 which allows reduction of the overall weight and access of the inside space of the stair-like structure to be further described hereinafter.

The tread boards 54 and 58 may be provided with an anti-slippery pad 64 disposed thereon for safety purpose. Preferably, the tread boards 54 and 58 have a recess formed thereon corresponding to the size of the anti-slippery pads 64 for receiving and holding the anti-slippery pads 64 therein but such a recess is not a must for the present invention. In the cross-sectional view shown in FIG. 8, there is no such recess provided on the tread boards 54 and 58. The anti-slippery pads 64 may be received within the recesses formed on the tread boards 54 and 58 so as to provide a substantially even top surface of the tread boards 54 and 58. Alternatively, the anti-slippery pads 64 may project above the top surface of the tread boards 54 and 58 so that in overlapping the boards 54, 56, 58 and 60 on each other, the anti-slippery pads 64 may be partially received within the hollow frame of the riser board 56 and a recess of corresponding size and shape formed on the riser board 60. In this regard, the hollow frame of the riser board 56 is shaped and sized to correspond to the anti-slippery pad 64.

Figure 8:
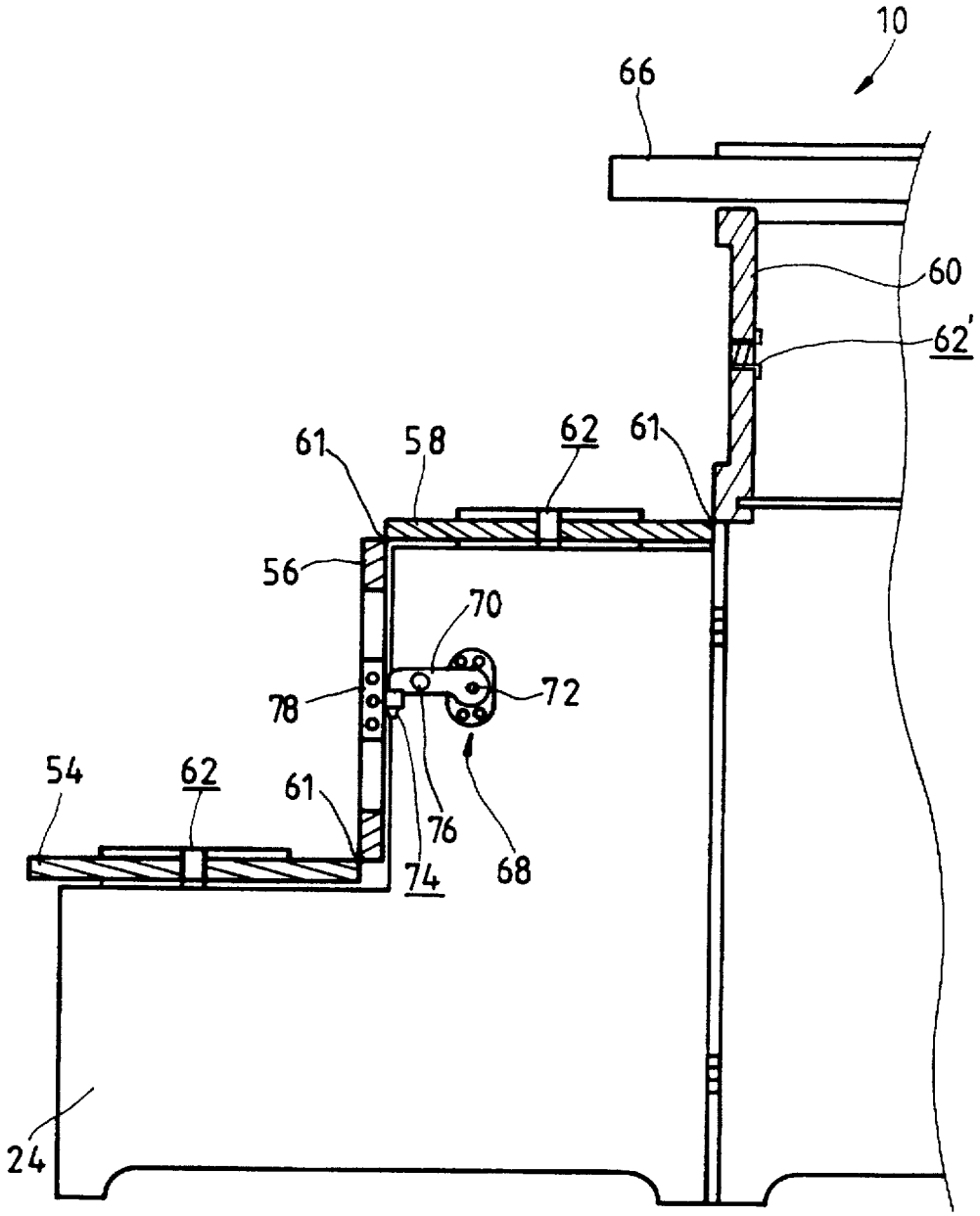
FIG. 8 is a sectional side elevational view showing the inside structure of the ladder.

Also, the through holes 62 that are formed on the tread boards 54 and 58 for receiving the stem 63 of the manual knob 26 of the drawer 16 are extended through the anti-slippery pads 64 to allow the stem 63 to extend therethrough, see FIG. 8.

The top side of the cabinet 10 may serve as a platform 66 of the platform ladder expanded from the cabinet 10. An anti-slippery pad 67 may be additionally and optionally provided on the platform 66.

Figure 9:
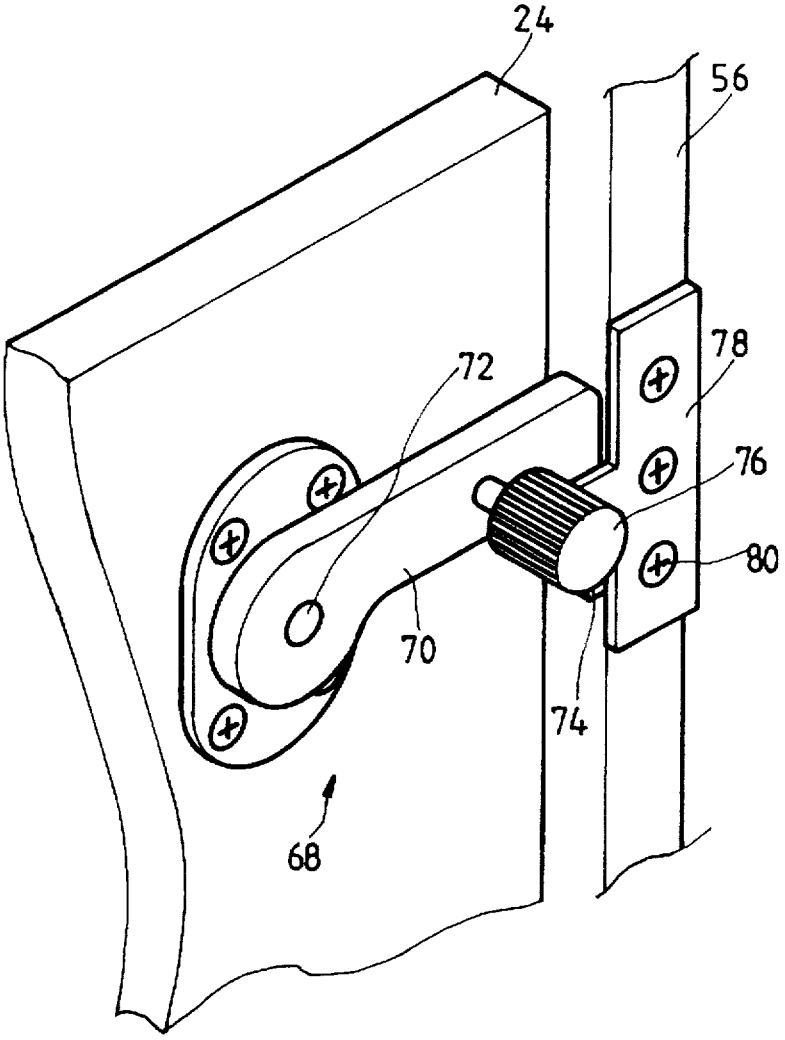
FIG. 9 is a perspective view showing a latch used to retain the ladder in the expanded condition.
Figure 10:
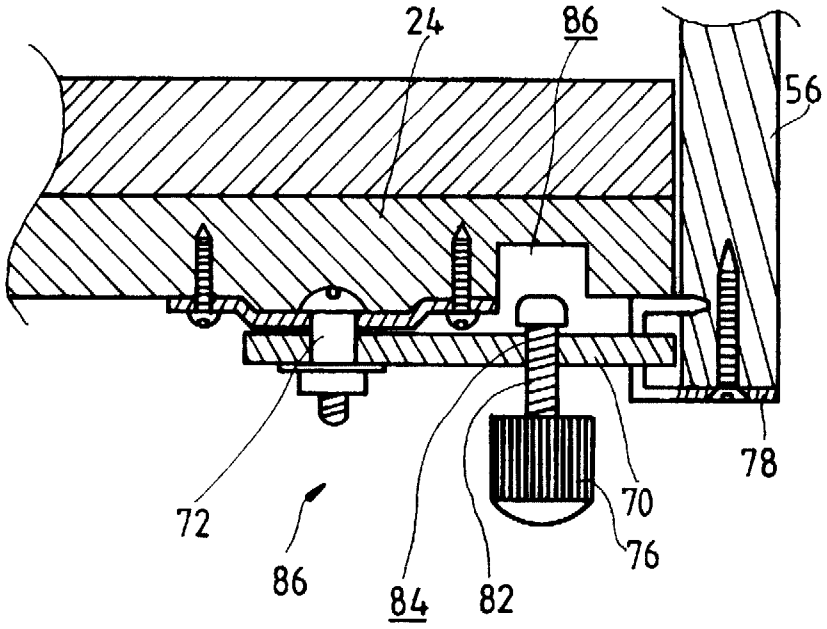
FIG. 10 is a sectional view of the latch.

Latch means 68 is provided to secure the boards 54, 56, 58 and 60 in the expanded stair-like condition. The latch means 68 which is best shown in FIGS. 8–10 comprises a rotary latch 70 which is pivoted to one of the L-shaped panels 22 and 24 (which is the panel 24 in the embodiment illustrated) at one end by means of a pivot pin 72 and having a hook-like bent section 74 at the opposite end. A manual knob 76 is provided on the rotary latch 70 to manually rotate the hook-like end 74 about the pivot pin 72 between a latched position where the hook-like end 74 is received within a loop-like member 78 fixed on the riser board 56 so as to secure the boards 54, 56, 58 and 60 in the expanded condition and a released position where the hook-like end 74 is disengaged from the loop-like member 78 to allow the boards 54, 56, 58 and 60 to disengage from the L-shaped panels 24 and 28 and to overlap each other.

Preferably, the latch means 68 comprises a second rotary latch associated with the L-shaped panel 22 in a manner to be substantially opposite to that associated with the L-shaped panel 24.

In the embodiment illustrated, the hollow frame structure of the riser board 54 allows the loop-like member 78 to be fixed on the opening of the riser board 54 by means of for example screws 80.

Preferably, the manual knob 76 comprises a threaded stem 82, see FIG. 10, which is in threading engagement with a threaded hole 84 formed on the rotary latch 70. The L-shaped panel 24 on which the latch means 68 is mounted comprises a bore 86 located at such a position that when the latch 70 engages the loop-like member 78, an end portion of the stem 82 is movable into the bore 86 by manually turning the stem 82 in the threaded hole 84 so as to secure the rotary latch 70 in the latched position.

The opening of the hollow frame like riser board 56 allow a user's access to the latch means 68 for manually operating the latch means 68.

Figure 11:
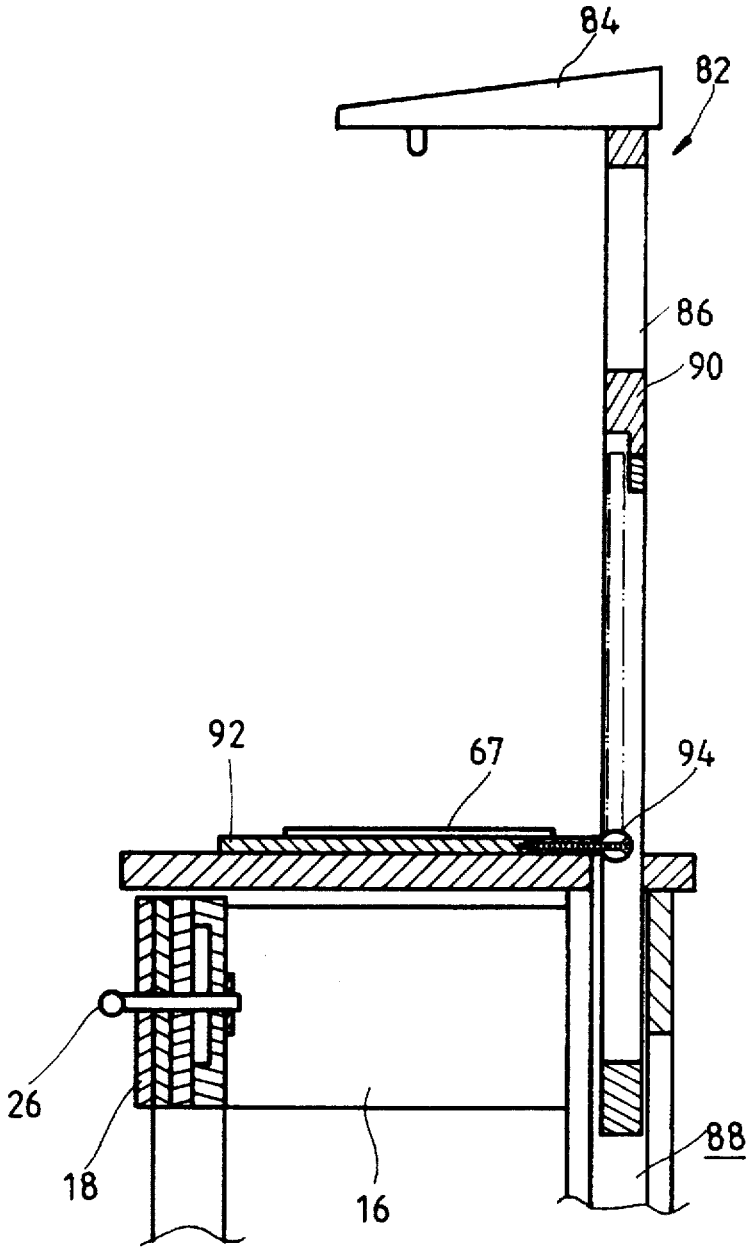
FIG. 11 is a partial side elevational view showing the anti-slipper panel mounted on the ladder.
Figure 12:
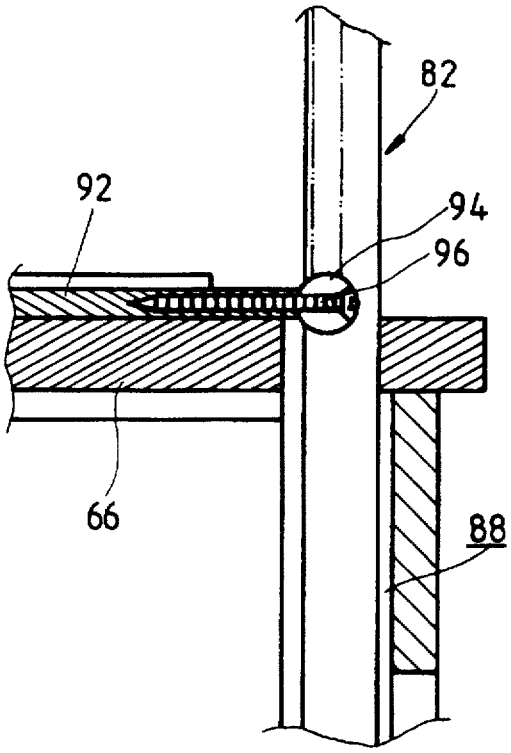
FIG. 12 is a partial sectional view showing the mounting of the anti-slippery panel to the ladder.
Figure 13:
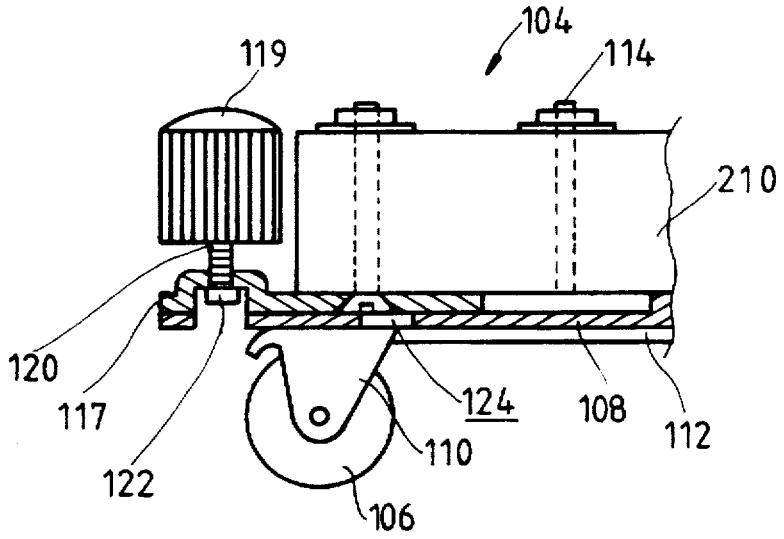
FIGS. 13 and 14 are partial sectional views showing a caster that is mounted under the cabinet.

A safety rack assembly 82 is provided on the platform 66 of the ladder expanded from the cabinet 10. The safety rack assembly 82 comprises a top rack 84 mounted on two support rods 86 which are telescopically or movably received within a vertical channel 88 formed inside the cabinet 10, as shown in FIG. 6. A cross bar 90 connects between the two rods 86 with a movable plate 92 is disposed thereunder and between the two rods 86. The movable plate 92 has a lower edge pivoted (at 94 as best shown in FIG. 12) to the rods 86 so as to be rotatable between a stowed position where the plate 92 is positioned between and substantially parallel with the rods 86 (dashed line of FIGS. 11 and 12) and an operating position where the plate 92 is positioned on the platform 66 to overlap the platform 66 (solid line of FIGS. 11 and 12) which also functions to retain the safety rack assembly 82 in the expanded condition. As shown in FIG. 12, the pivot 94 comprises an elongated cylindrical bar to which the plate 92 is secured by means of for example screws 96.

Figure 7:
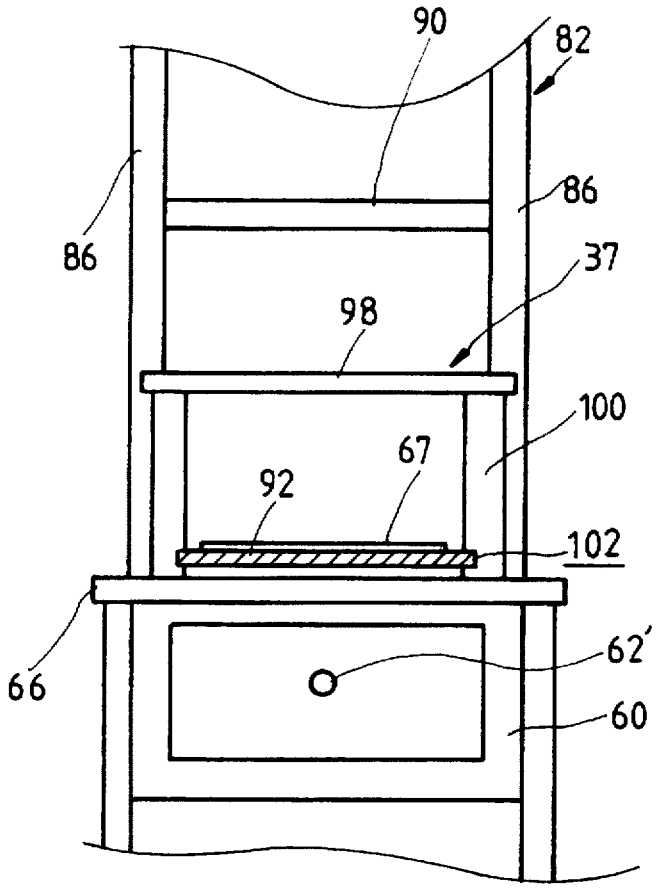
FIG. 7 is a front view of the ladder with the additional step mounted.

Referring to FIGS. 6 and 7, the stool 37 that is optionally stored inside the interior space of the bin section 14 is constituted by a top plate 98 with two spaced and opposite leg plates 100 fixed on the underside of the top plate 100 and extending therefrom. Each of the leg plates 100 is provided with a slot 102 at such a position to have lateral edge of the plate 92 receivable therein when the plate 92 is in the operating position so as to mount the stool 37 to the plate 92 which allows the stool 37 to be fixed on the platform 66. The stool 37 thus serves as an additional step of the platform ladder expanded from the cabinet 10 of the present invention.

Figure 17:
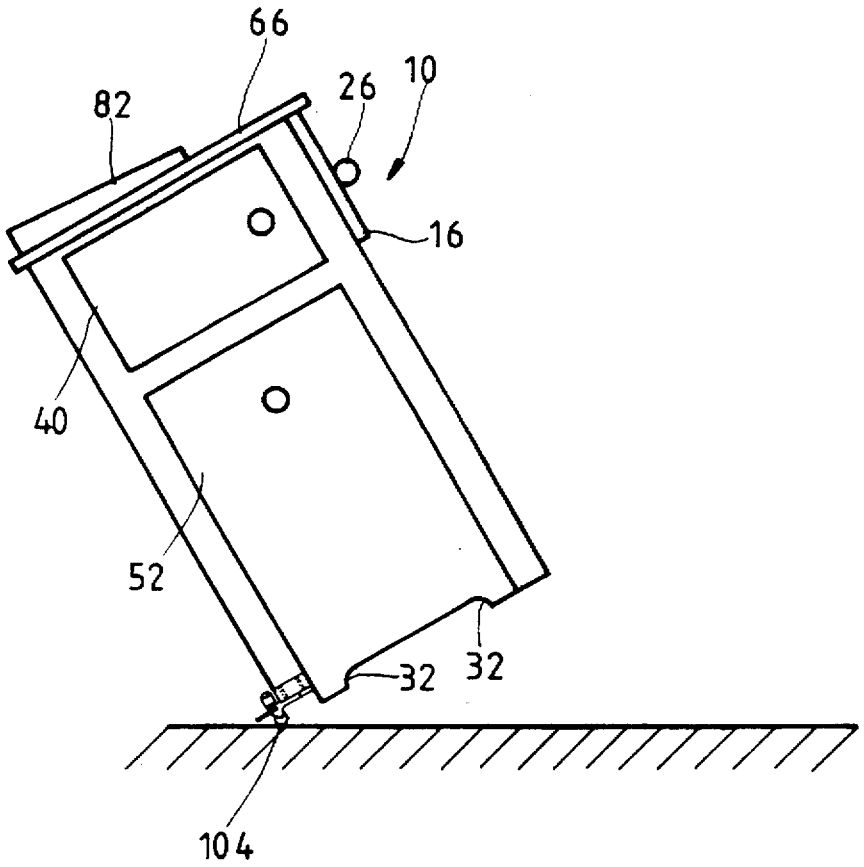
FIG. 17 is a side elevational view showing moving the cabinet with the aid of the caster.

In a second embodiment of the present invention, to provide the cabinet of the present invention with maneuverability, the cabinet 10 may optionally comprise two casters 104 mounted at the rear side thereof, as shown in FIG. 17. To distinguish, the second embodiment cabinet in accordance with the present invention shown in FIGS. 17 and 18 that has casters 104 is distinguishingly designated with reference numeral 210, but similar or identical members or parts that are also shown in the first embodiment are designated with the same reference numerals.

Figure 18:
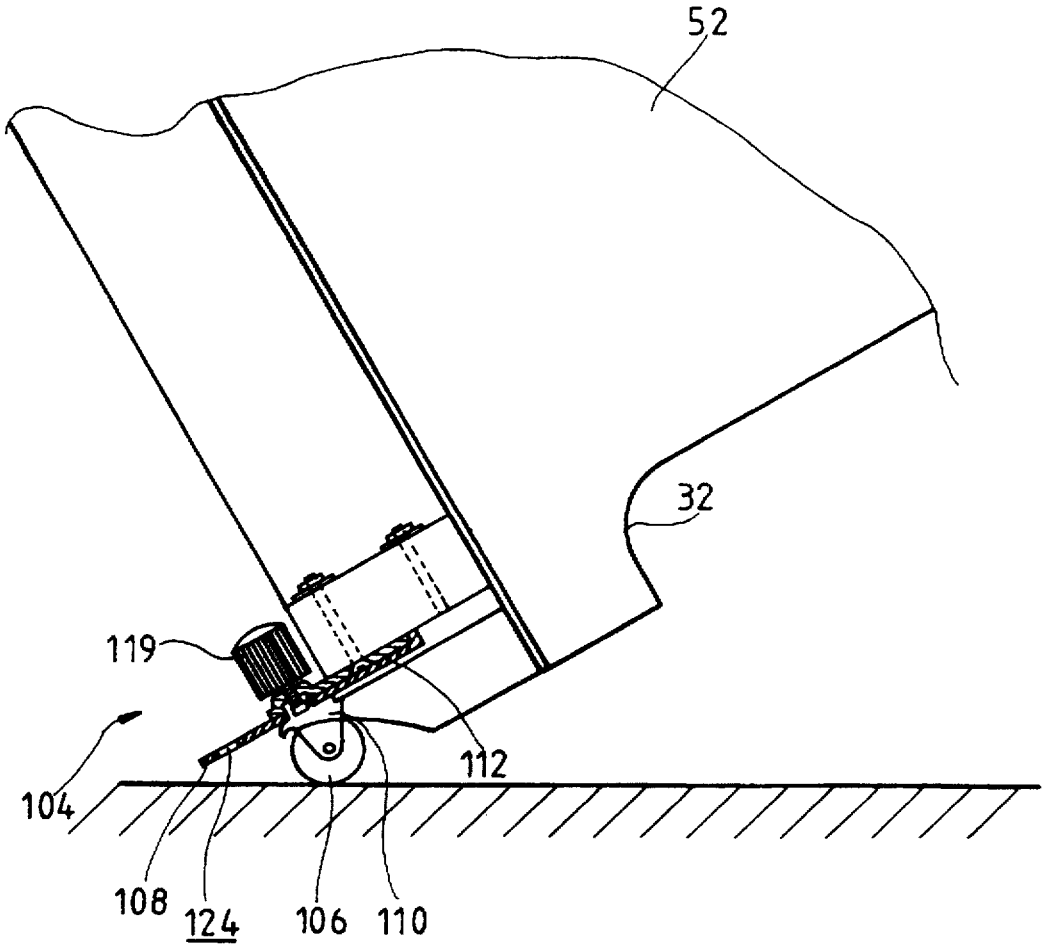
FIG. 18 is a partial sectional view showing moving the cabinet with the aid of the caster.

The casters 104 allow the cabinet 210 to be readily moved by inclining the cabinet 210 in such a way to have the cabinet 210 is supported on the ground only the casters 104, as particularly shown in the enlarged view of FIG. 18.

As shown in FIGS. 13–16, the casters 104 comprise a wheel or roller 106 which is rotatably mounted to a slide plate 108 by being interposed between and pivoted to two spaced bracket plates 110 that are fixed to the slide plate 108. Two spaced guide rails 112 are mounted on the underside of the bottom of the cabinet 210 by means of for example bolts 114. The guide rails 112 may be fixed on a mount plate 116 which is in turn fixed to the underside of the bottom of the cabinet 210 by means of the bolts 114. The spacing between the guide rails 112 allows the slide plate 108 to be slidably received between and supported on the two guide rails 112.

The mount plate 116 comprises an extension 117 projecting out of the bottom of the cabinet 210 with an inner-threaded hole 118 formed thereon. A manual control knob 119 having a threaded stem 120 is in threading engagement with the inner-threaded hole 118 to be axially movable relative to the mount plate 116 by rotating the knob 119. A lower end 122 of the stem 120 is movable relative to the slide plate 108 by the rotation of the knob 119 between a secured position where the end 122 is received into one of a plurality of through holes 124 formed on the slide plate 108 so as to secure the slide plate 108 relative to the mount plate 116 (or the guide rails 112) and a released position where the end 122 disengages the through holes 124 to allow the slide plate 108 to be free to move relative to the mount plate 116.

Figure 14:
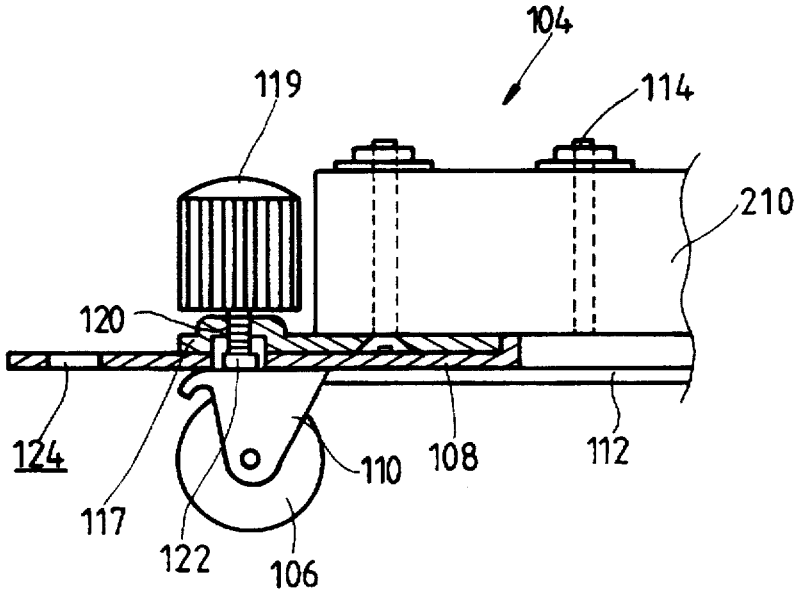
Figure 15:
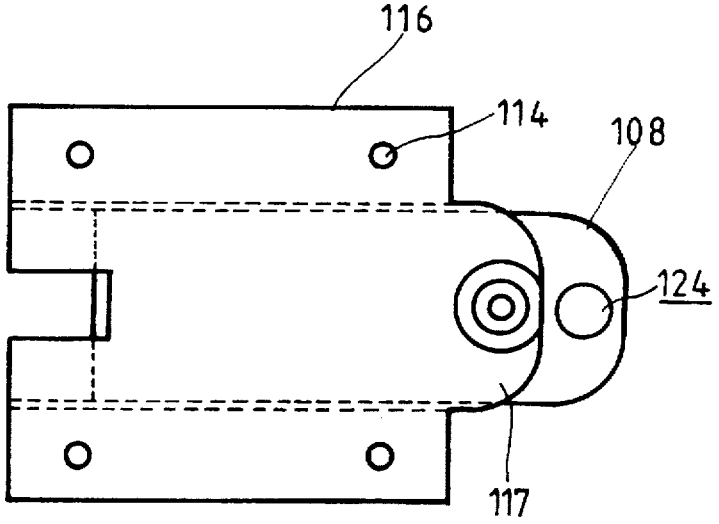
FIG. 15 is a top view of the caster.
Figure 16:
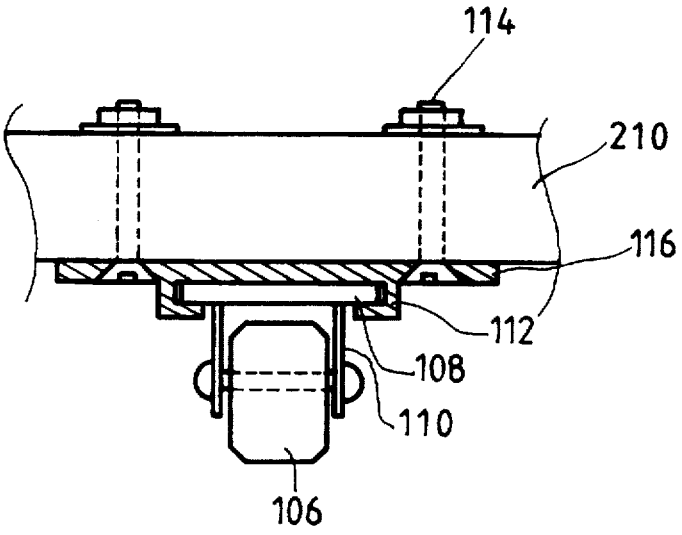
FIG. 16 is a front view of the caster.

In the embodiment illustrated, there are two through holes 124 provided on the slide plate 108 respectively corresponding to a stowed position of the caster 104 (FIG. 13) and an operating position of the caster 104 (FIG. 14). In the stowed position, the distance between the center of the caster 104 and the rear leg 32 is minimum which hides the caster 104 under the bottom of the cabinet 210 and thus deactivates the function of the caster 104 and in the operating position, the distance is the maximum so that the caster 104 is located outside the bottom of the cabinet 210, thus allowing the caster 104 to roll without interference.

Although a preferred embodiment has been described to illustrate the present invention, it is apparent that changes and modifications in the specifically described embodiment can be carried out without departing from the scope of the invention which is intended to be limited only by the appended claims.

What is claimed is:

1. A cabinet comprising a frame having a top side covered by a top wall and a bottom side, a front side and a rear side and two opposite lateral sides, the frame having an upper portion within which a drawer is received and a lower portion which defines a bin, the drawer comprising a drawer front panel comprised of four boards foldable to overlap each other and releasably secured together in the overlapping condition with a first securing means, the bin portion comprising two L-shaped door panels arranged to be opposite to each other and respectively hinged to the lateral sides to be rotatable between a closed position where the L-shaped door panels cover the front side of the bin portion of the cabinet frame with lower sections of the L's overlapping each other and an expanded position where the L-shaped door panels are rotated away from the cabinet frame to be substantially parallel with and spaced from each other and thus defining a stair-like configuration having two steps, wherein the boards of the drawer front panel are released and expanded to have alternate ones of the boards supported on the two steps of the L-shaped door panels to serve as treads of the stair-like configuration and the remaining boards serving as risers of the stair-like configuration so as to form a platform ladder with the top wall of the cabinet serving as platform of the platform ladder, a second securing means being provided to releasably secure the boards in the expanded condition which defines the platform ladder.

2. The cabinet as claimed in claim 1, wherein the first securing means comprises a threaded stem extendible through an opening formed on each of the boards to engage an inner-threaded hole formed on an innermost one of the boards.

3. The cabinet as claimed in claim 1, wherein the second securing means comprises a rotary latch which is pivoted to at least one of the L-shaped door panels and manually movable between a latched position where the latch engages a counterpart securing member fixed on one of the boards and a released position where the latch disengages from the counterpart securing member.

4. The cabinet as claimed in claim 3, wherein the rotary latch comprises a hook-like end and the counterpart securing member comprises a loop-like portion engageable by the hook-like end to secure the rotary latch in the latched position.

5. The cabinet as claimed in claim 3, wherein the rotary latch comprises a manual control knob which has a threaded stem extending through and engaging a threaded hole formed on the latch to allow an end of the stem to move into a bore formed on the door panel when the rotary latch is in the latched position to prevent the rotary latch from accidentally disengaging the counterpart securing member.

6. The cabinet as claimed in claim 5, wherein the rotary latch is mounted on an inside surface of the door panel and wherein one of the boards comprises an opening large enough to allow user's access to and control of the rotary latch that is fixed inside the platform ladder.

7. The cabinet as claimed in claim 6, wherein the second securing means comprises two rotary latches respectively mounted on the two door panels to cooperate two counterpart securing members fixed on the boards to releasably secure the boards in the expanded condition.

8. The cabinet as claimed in claim 1, further comprising a safety rack assembly which is mounted on the platform and is movably received within a vertical channel formed inside the cabinet so as to be selectively moved between a stewed position where the rack assembly is received inside the vertical channel and an expanded position where the rack assembly is located on and above the platform.

9. The cabinet as claimed in claim 8, wherein the rack assembly comprises two spaced vertical rods connected to each other by a cross bar and a top rack member mounted to top ends of the rods, a movable plate pivoted between the two rods to be movable between a first position where the plate is located between and substantially parallel with the rods and a second position where the plate is substantially supported on the platform so as to retain the safety rack assembly in the expanded position.

10. The cabinet as claimed in claim 1, wherein an inner casing comprising a horizontal partition wall is provided inside the cabinet frame to define, along with the bottom side of the cabinet frame, an interior space of the bin, the interior space being further defined by two lateral side partition walls, the horizontal partition wall further defining a spacing with the drawer, wherein the lateral sides of the cabinet corresponding to the bin door panels are open, a side panel being sized to cover the lateral side opening and releasably attached to one of the two lateral side partition walls.

11. The cabinet as claimed in claim 10, further comprising a bench assembly having a horizontal top plate having an inner end movably received within the spacing defined between the horizontal partition wall and the drawer and slidably supported on the horizontal partition wall and a vertical support plate perpendicularly fixed to an outer end of the horizontal top plate and extending downward therefrom so that the horizontal top plate is supported at the two ends by the horizontal partition wall and the support plate, the bench assembly being sized so as to allow the bench assembly to be completely received within the cabinet frame.

12. The cabinet as claimed in claim 11, wherein the support plate of the bench assembly is sized to cover the lateral side opening of the cabinet frame.

13. The cabinet as claimed in claim 12, wherein the support plate of the bench assembly is releasably attached to one of the lateral side partition walls of the inner casing.

14. The cabinet as claimed in claim 9, further comprising a stool defined by a top plate with two leg plates extending downward therefrom, each of the leg plates having a slot formed thereon and opposite to each other to receive therein one of two opposite lateral edges of the movable plate of the safety rack assembly so as to secure the stool on the platform to provide an additional step of the platform ladder.

15. The cabinet as claimed in claim 1, wherein a portion of at least one of the two lateral sides of the cabinet frame that corresponds to the drawer is open, a sideboard being hinged to the cabinet frame to openably cover the opening of the lateral side, an article holder means being provided inside the sideboard for receiving and holding articles therein.

16. The cabinet as claimed in claim 1, wherein each of the tread boards is provided with an anti-slippery pad thereon.

17. The cabinet as claimed in claim 1, wherein the platform comprises an anti-slippery pad disposed thereon.

18. The cabinet as claimed in claim 1, further comprising two casters mounted under the bottom side of the cabinet frame and located at the rear side thereof.

19. The cabinet as claimed in claim 18, wherein each of the casters comprises a wheel interposed between and rotatably supported on two bracket plates which are fixed to a slide plate that is slidably received within and supported by two spaced rails fixed on the bottom side of the cabinet frame so as to allow the wheel to be movable relative to the cabinet frame and positionable at one of a plurality of predetermined locations relative to the cabinet frame by means of a third securing means.

20. The cabinet as claimed in claim 19, wherein third securing means comprises a threaded rod that is provided with a manually turning knob and extending through and threadingly engaging an inner-threaded hole provided on an extension projecting laterally from the bottom of the cabinet so that by turning the threaded rod relative to the extension of the bottom of the cabinet frame, a free end of the threaded rod is movable toward and into one of a plurality of holes, that correspond to said predetermined locations, formed on the slide plate to selectively secure the slide plate at positions corresponding to the holes.

* * * * *